US006932640B1

(12) United States Patent
Sung

(10) Patent No.: US 6,932,640 B1
(45) Date of Patent: Aug. 23, 2005

(54) HDMI CONNECTOR

(76) Inventor: Yun-Ching Sung, No. 53-2, Community 6, Chih Pa Sub-Ward, ChungLi City, TaoYuan Hsien (TW)

( * ) Notice: Subject to any disclaimer, the term of this patent is extended or adjusted under 35 U.S.C. 154(b) by 0 days.

(21) Appl. No.: 10/969,883

(22) Filed: Oct. 22, 2004

(51) Int. Cl.[7] ..... H01R 4/24
(52) U.S. Cl. ..... 439/405; 439/417; 439/604; 439/610
(58) Field of Search ..... 439/405, 404, 439/395, 417, 604, 610, 607

(56) References Cited

U.S. PATENT DOCUMENTS 5,643,005 A * 7/1997 Weidler et al. ..... 439/405
5,911,594 A * 6/1999 Baker et al. ..... 439/404
6,171,134 B1 * 1/2001 Lai ..... 439/405
6,270,372 B1 * 8/2001 Jenner et al. ..... 439/405
6,790,075 B1 * 9/2004 Sung ..... 439/499
6,869,306 B1 * 3/2005 Sung ..... 439/449

* cited by examiner

*Primary Examiner*—Hien Vu
(74) *Attorney, Agent, or Firm*—Rosenberg, Klein & Lee

(57) ABSTRACT

A HDMI connector is disclosed to include an insulative casing holding first terminals and second terminals at two different elevations, an insulative locating board set in between the first terminals and second terminals, top and bottom cove boards respectively covered on the top and bottom sides of the locating boards to hold down lead wires of a cable in respective forked, sharp-edged endpieces of the first terminals and second terminals at the top and bottom sides of the insulative locating board to make a respective electric contact, a cap fastened to the cable to keep the lead wires from sight, a metal shield covered on the casing and the cover boards and the cap for EMI protection, and a plastic housing directly molded on the metal shield.

3 Claims, 15 Drawing Sheets

HDMI CONNECTOR

BACKGROUND OF THE INVENTION a. Field of the Invention:

The present invention relates to an electric connector and more particularly, to a HDMI (Hi-Definition Mutimedia Interface) connector, which is easy to assemble without soldering or riveting.

b. Description of the Related Art:

HDMI (Hi-Definition Mutimedia Interface) is a transmission interface developed for the next generation multimedia audio video systems including DVD players, game box converter, TV box, and etc. The maximum transmission speed of HDMI interface can be as high as 5 Gb/s. In addition to video signal, HDMI interface can simultaneously transmit 8-channel audio signal. Because HDMI is practical for transmitting digital data without compression, it effectively reduces signal interference and attenuation due to conversion between digital signal and analog signal. Therefore, SONY, Panasonic, Pioneer, Thomson, Samsung, LG, and other world famous electronic companies have installed in their newly developed products this HDMI interface.

A HDMI connector is a small-size connector developed following the step of SATA (Serial AT attachment) interface connector. Because a HDMI connector has 20 lines (including one for grounding), the connection of the lead wires to the terminals is complicated and much difficult than a SATA interface connector.

FIG. 1 shows one arrangement of the connection between the lead wires 104 of the cable 103 and the connector body 101 of a conventional HDMI connector. As illustrated, terminals 102 are extended out of respective terminal holes of the connector body 101 and respectively soldered to the conductors 104 of the cable 103. After connection of the terminals 102 to the conductors 104 of the cable 103, a plastic housing (not shown) is directly molded on the connector body 101 and the cable 103. It is complicated to solder the terminals 102 to the conductors 104 of the cable 103. During soldering a toxic gas will be produced. Further, because the conductors 104 of the cable 103 are thin wires, it is difficult to control the soldering quality. Improper solder affects the quality of the HDMI connector.

FIG. 2 shows another arrangement of the connection between the conductors 104 of the cable 103 and the connector body 101 of a conventional HDMI connector. According to this arrangement, the terminals 102 are respectively fastened to the conductors 104 of the cable 103 with a respective rivet 105. Connecting the terminals 102 to the conductors 104 of the cable 103 with a respective rivet 105 is not easy. Because the cable 103 has total 20 conductors 104, it is difficult to fasten the conductors 104 to the terminals 102 by means of an automatic machine.

Therefore, it is desirable to provide an HDMI connector, which eliminates the aforesaid drawbacks.

SUMMARY OF THE INVENTION

The present invention has been accomplished under the circumstances in view. It is the main object of the present invention to provide an HDMI connector, which keeps the lead wires of the cable positively electrically connected to the respective terminals without soldering or riveting.

To achieve this and other objects of the present invention, the HDMI connector comprises an electrically insulative casing, the casing comprising two protruding blocks respectively vertically extended from a rear sidewall thereof on the middle in reversed directions; a set of terminals, the terminals including a plurality of first terminals horizontally arranged in the casing at an upper side and a plurality of second terminals horizontally arranged in the casing at a lower side below the first terminals, the first terminals being axially alternatively extended out of the rear sidewall of the casing at two different distances, the second terminals being axially alternatively extended out of the rear sidewall of the casing at two different distances, the first terminals each having an upwardly extended, forked, sharp-edged endpiece suspending outside the casing, the second terminals each having a downwardly extended, forked, sharp-edged endpiece suspending outside the casing; an electrically insulative locating board fastened to the casing and set between the first terminals and the second terminals, the locating board comprising a plurality of first locating pins and second locating pins respectively perpendicularly extended from top and bottom sides thereof on the middle, and a plurality of locating holes in four corners thereof; a top cover board and a bottom cover board respectively fastened to the top and bottom sides of the locating board, the top cover board and the bottom cover board each having a plurality of mounting holes respectively coupled to the first locating pins and second locating pins of the locating board, and a plurality of retainers respectively fastened to the locating holes of the locating board, the top cover board having a plurality of parallel terminal grooves formed in a bottom side thereof for accommodating the upwardly extended, forked, sharp-edged endpieces of the first terminals, the bottom cover board having a plurality of parallel terminal grooves formed in a top side thereof for accommodating the downwardly extended, forked, sharp-edged endpieces of the second terminals; a cable, the cable having a plurality of lead wires arranged into two groups respectively inserted into the terminal grooves of the top cover board and the terminal grooves of the bottom cover board and respectively held down in the upwardly extended, forked, sharp-edged endpieces of the first terminals and the downwardly extended, forked, sharp-edged endpieces of the second terminals by the top cover board and the bottom cover board and respectively kept in electric contact with the first terminals and the second terminals; a protective cap mounted on the cable and closely attached to the top cover board and the bottom cover board and the locating board at a rear side to protect the lead wires of the cable and to keep the lead wires of the cable from sight; a metal shield covered on the top cover board and the bottom cover board and the protective cap for EMI (Electromagnetic interference) protection, the metal shield having a part covered on the periphery of the casing and forming with the casing a connection interface; and a plastic housing molded on the metal shield and the cable beyond the connection interface.

DETAILED DESCRIPTION OF THE PREFERRED EMBODIMENTS

Figure 1:
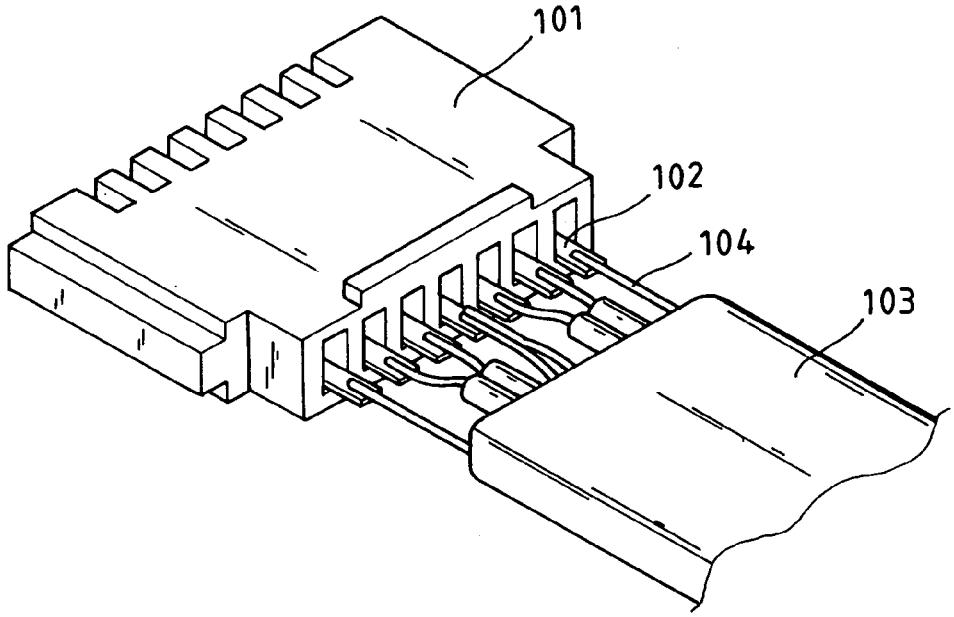
FIG. 1 PRIOR ART
FIG. 1 is illustrates one arrangement of the connection in a HDMI connector between the terminals and conductors of the cable according to the prior art.
Figure 2:
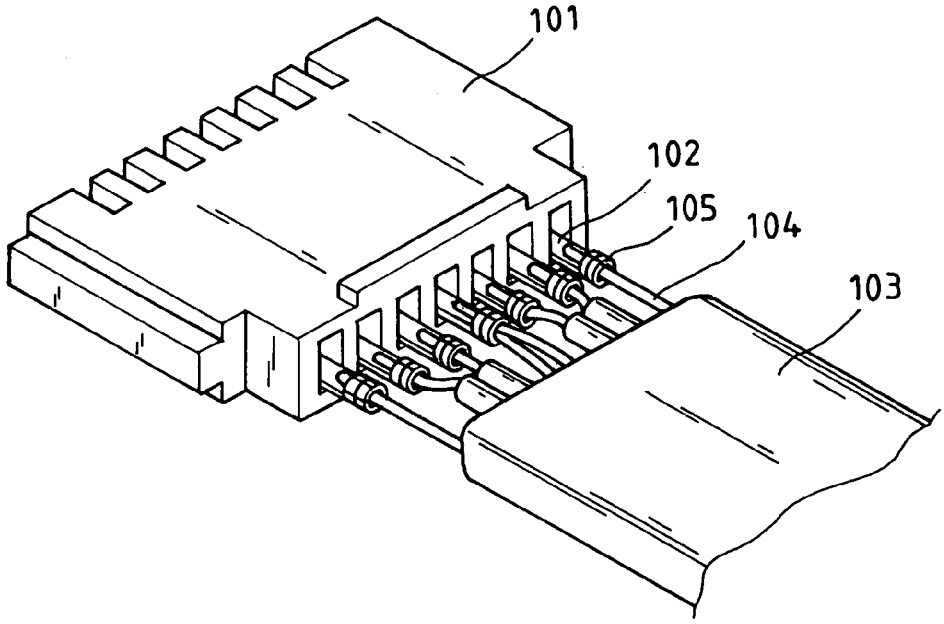
FIG. 2 PRIOR ART
FIG. 2 illustrates another arrangement of the connection in a HDMI connector between the terminals and conductors of the cable according to the prior art.
Figure 3:
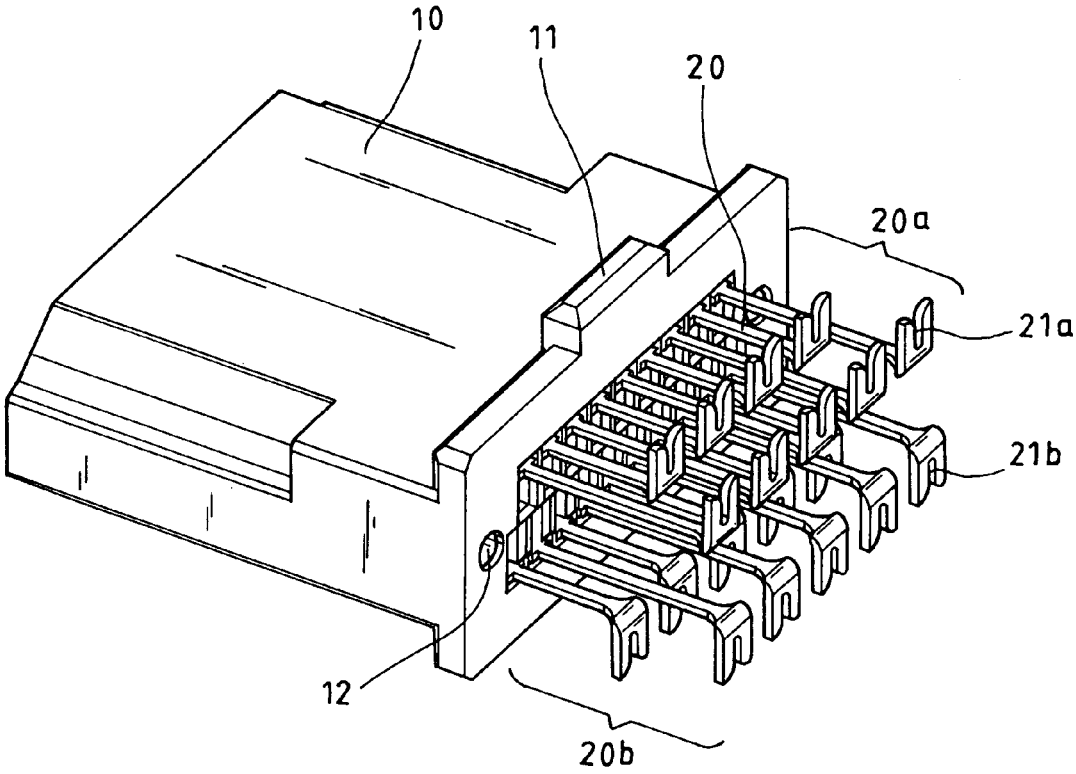
FIG. 3 is an elevational view of a part of a HDMI (Hi-Definition Mutimedia Interface) connector according to the present invention, showing terminals installed in the casing.

Referring to FIG. 3, an electrically insulative casing 10 is shown having two protruding blocks 11 respectively vertically extended from the rear sidewall on the middle in reversed directions and two mounting holes 12 bilaterally formed in the rear sidewall The casing 10 holds a set of terminals 20. According to this embodiment, there are total 19 pieces of terminals 20. The terminals 20 include 9 pieces of first terminals 20*a* horizontally arranged at an upper side, and 10 pieces of second terminals 20*b* horizontally arranged at a lower side below the elevation of the first terminals 20*a*. The first terminals 20*a* are axially alternatively extended out of the rear sidewall at two different distances. Similarly, the second terminals 20*b* are axially alternatively extended out of the rear sidewall at two different distances. Further, the first terminals 20*a* each have an upwardly extended, forked, sharp-edged endpiece 21*a* suspending outside the casing 10, and the second terminals 20*b* each have a downwardly extended, forked, sharp-edged endpiece 21*b* suspending outside the casing 10.

Figure 4:
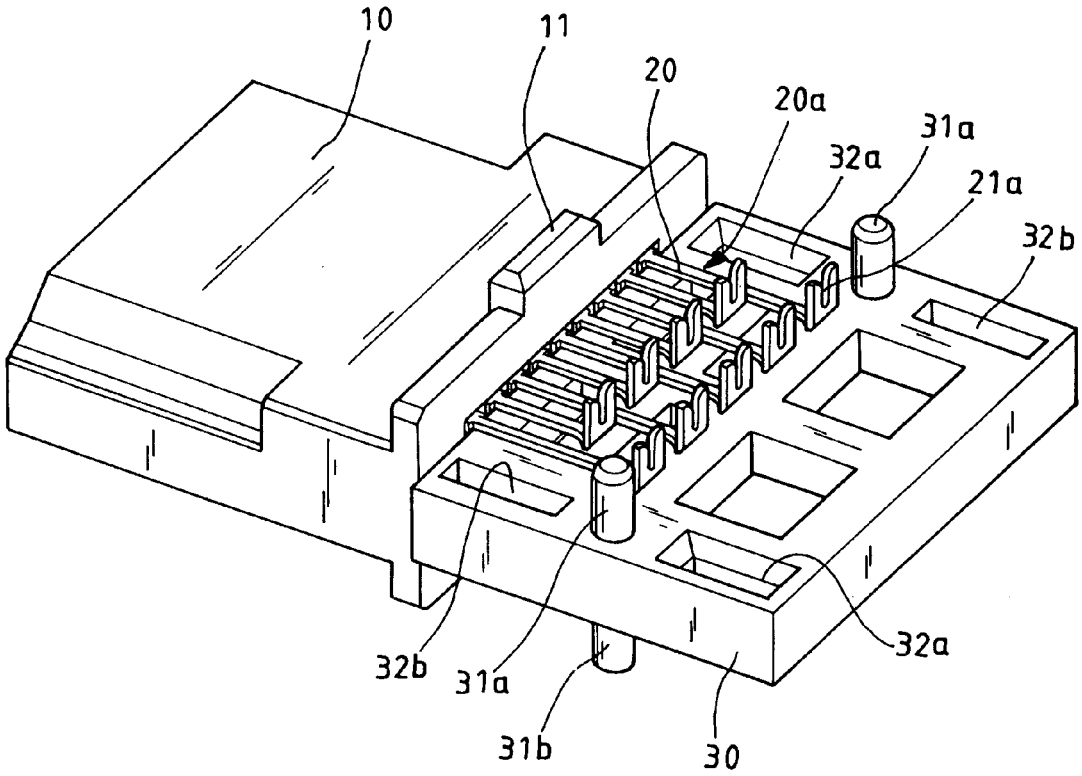
FIG. 4 is an elevational view of a part of the HDMI (Hi-Definition Mutimedia Interface) connector according to the present invention, showing the locating board fastened to the casing and set between the first terminals and the second terminals.
Figure 5:
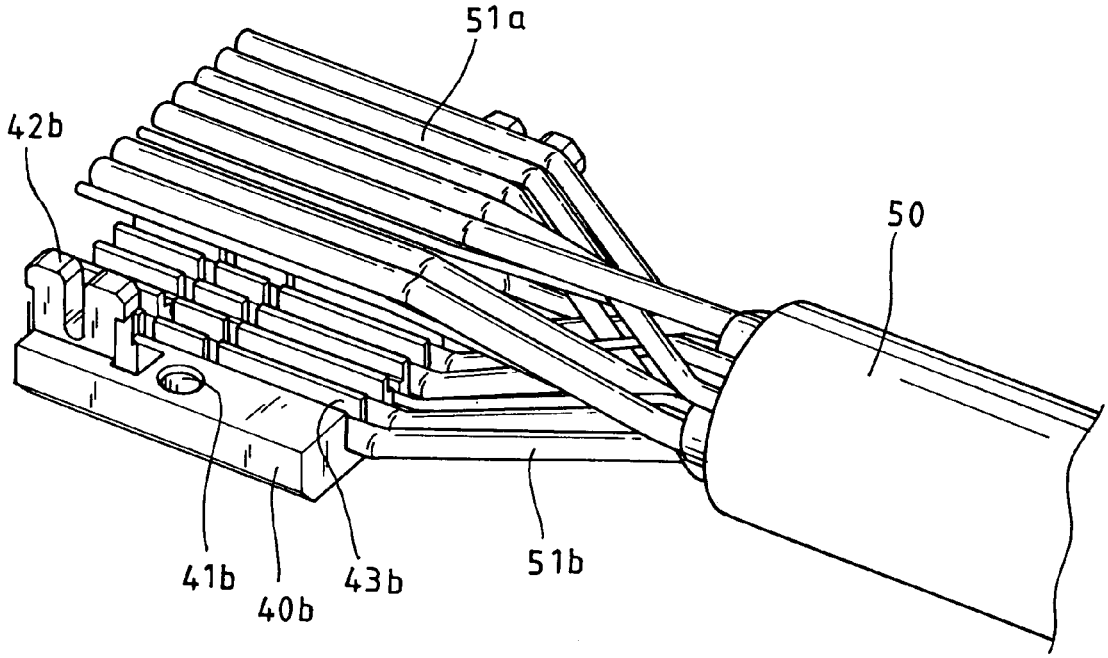
FIG. 5 is an elevational view of a part of the HDMI (Hi-Definition Mutimedia Interface) connector according to the present invention, showing the bottom cover board fastened to the second lead wires of the cable.
Figure 6:
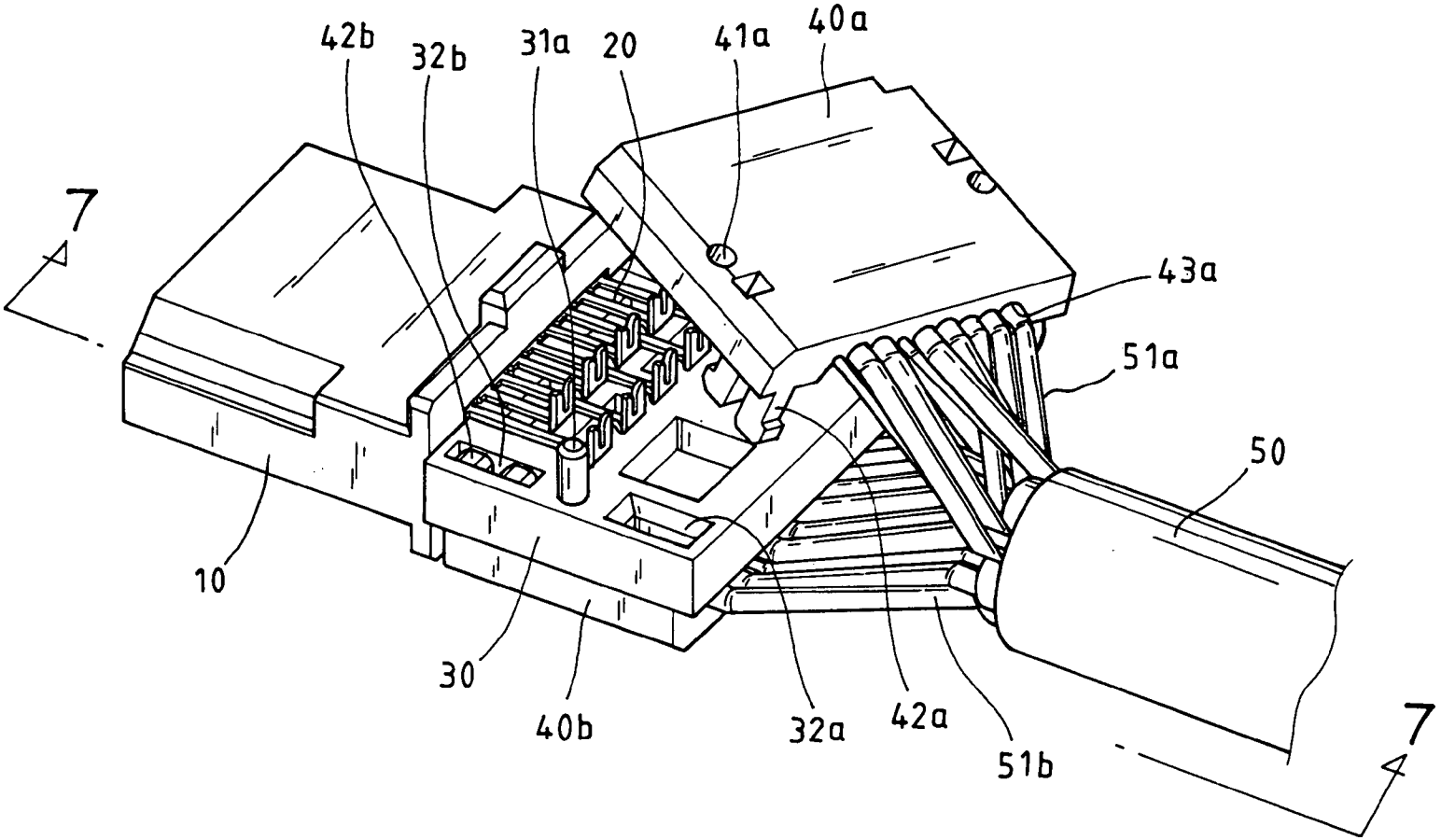
FIG. 6 is a schematic drawing of a part of the HDMI (Hi-Definition Mutimedia Interface) connector according to the present invention, showing the top cover board fastened to the first lead wires of the cable and the bottom cover board fastened to the second lead wires of the cable and the bottom side of the locating board.
Figure 7:
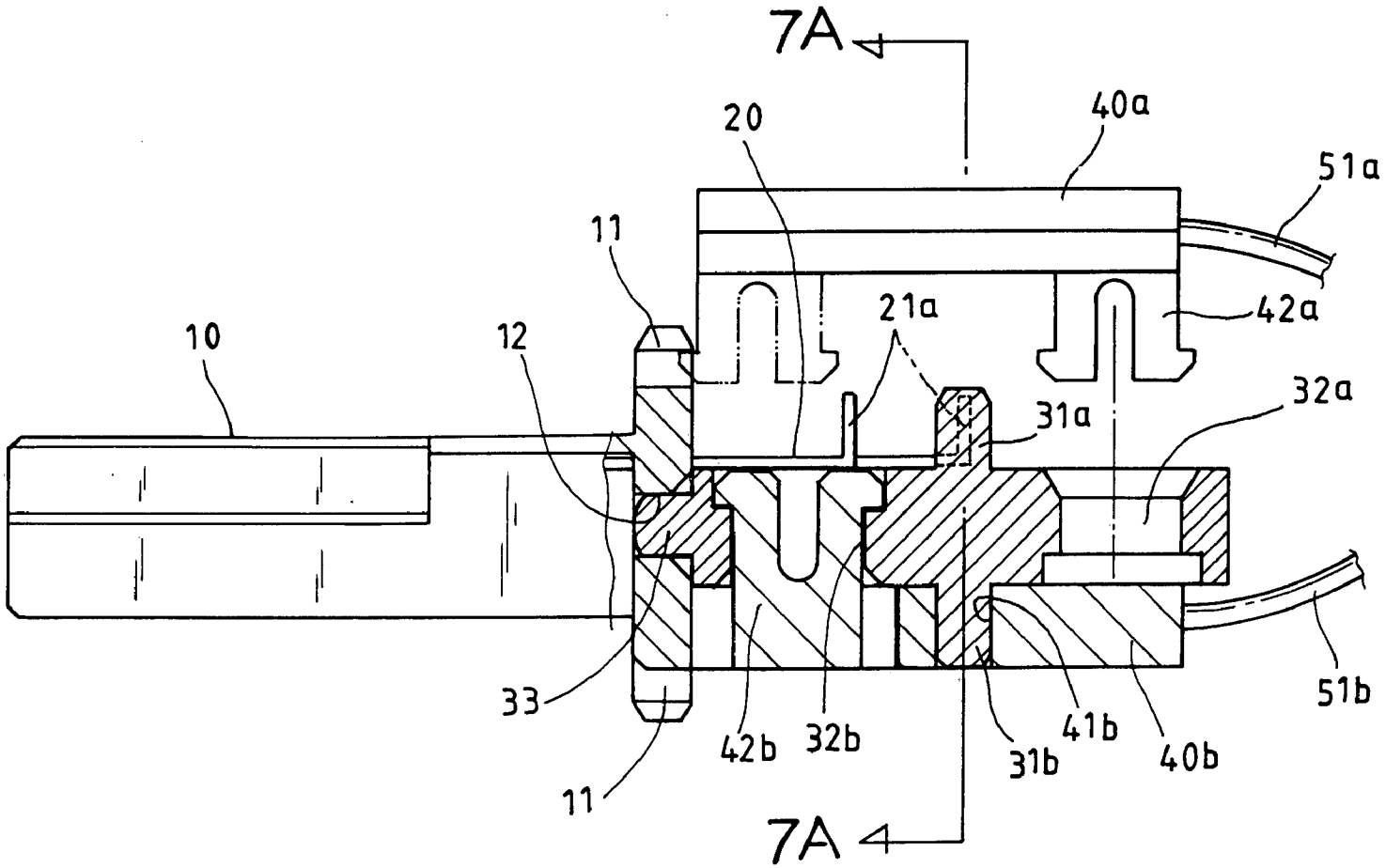
FIG. 7 is a sectional view taken along line 7—7 of FIG. 6.
Figure 7A:
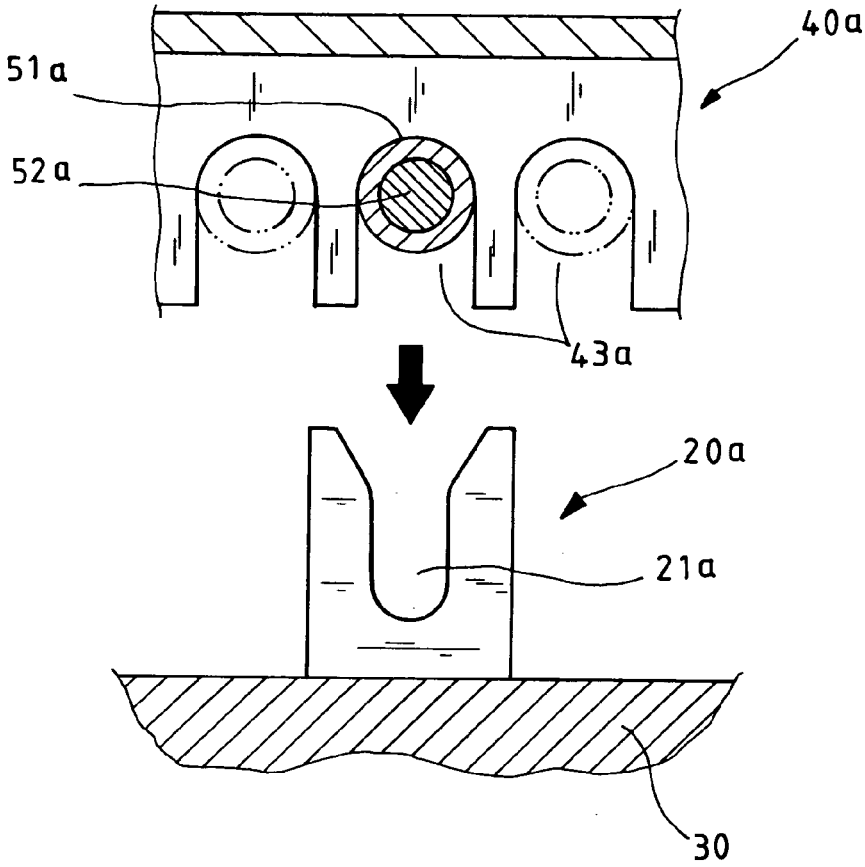
FIG. 7A is a sectional view in an enlarged scale taken along line 7A—7A of FIG. 7.
Figure 7B:
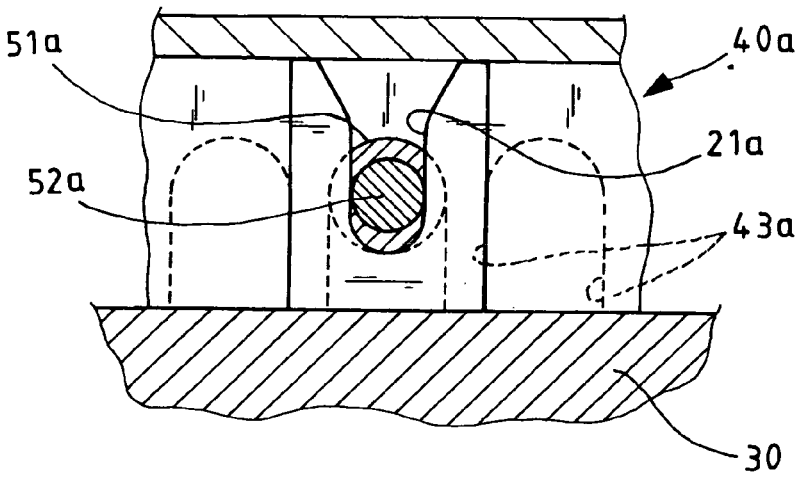
FIG. 7B is a sectional view in an enlarged scale taken along line 7B—7B of FIG. 7.

Referring to FIGS. 4 and 7 and FIG. 3 again, an electrically insulative locating board 30 is fastened to the rear side of the casing 10 and set between the first terminals 20*a* and the second terminals 20*b*. The locating board 30 comprises two plug rods 33 extended from the front side and respectively press-fitted into the mounting holes 12 of the casing 10, a plurality of first locating pins 31*a* and second locating pins 31*b* respectively perpendicularly extended from the top and bottom sides on the middle, and a plurality of locating holes 32*a* and 32*b* in the four corners.

Referring to FIGS. 5, 6, 7A, and 7B, a top cover board 40*a* and a bottom cover board 40*b* are respectively fastened to the top and bottom sides of the locating board 30 to hold the lead wires of a cable 50 in positive contact with the terminals 20. The cover boards 40*a* and 40*b* each have a plurality of mounting holes 41*a* or 41*b* respectively coupled to the first locating pins 31*a* and second locating pins 31*b* of the locating board 30, and a plurality of retainers 42*a* or 42*b* respectively fastened to the locating holes 32*a* and 32*b* of the locating board 30. The top cover board 40*a* further has a plurality of parallel terminal grooves 43*a* formed in the bottom side. The bottom cover board 40*b* further has a plurality of parallel terminal grooves 43*b* formed in the top side. According to this embodiment, the number of the terminal grooves 43*a* is 10, and the number of the terminal grooves 43*b* is also 10. The cable 50 has total 20 lead wires equally arranged into two sets, namely, the first lead wires 51*a* and the second lead wires 51*b*. The 10 pieces of first lead wires 51*a* include one for grounding. The first lead wires 51*a* are respectively set in the terminal grooves 43*a* of the top cover board 40*a*. The second lead wires 51*b* are respectively set in the terminal grooves 43*b* of the bottom cover board 40*b*. When fastening the top cover board 40*a* and the bottom cover board 40*b* to the top and bottom sides of the locating board 30, the other nine pieces of first lead wires 51*a* except the grounding lead wire and the second lead wires 51*b* will be respectively forced into the upwardly extended, forked, sharp-edged endpieces 21*a* of the first terminals 20*a* and the downwardly extended, forked, sharp-edged endpieces 21*b* of the second terminals 20*b*, thereby causing the upwardly extended, forked, sharp-edged endpieces 21*a* of the first terminals 20*a* and the downwardly extended, forked, sharp-edged endpieces 21*b* of the second terminals 20*b* to cut through the insulator of the respective lead wires 51*a* and 51*b* into contact with the conductors 52*a* and 52*b* (52*b* is not shown in the drawings) of the respective lead wires 51*a* and 51*b*.

Figure 8:
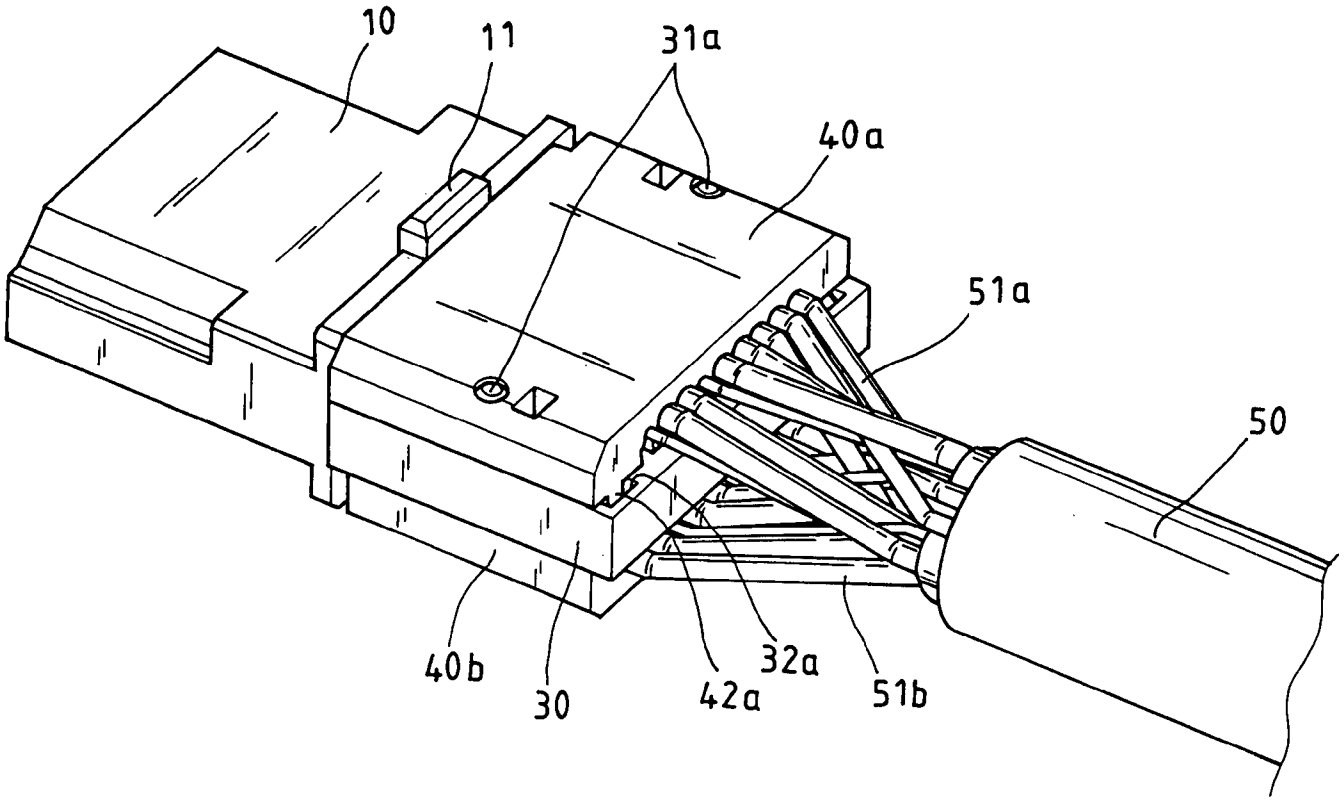
FIG. 8 is an elevational view of a part of the HDMI (Hi-Definition Mutimedia Interface) connector according to the present invention, showing the top cover board and the bottom cover board respectively fastened to the top and bottom sides of the locating board.
Figure 9:
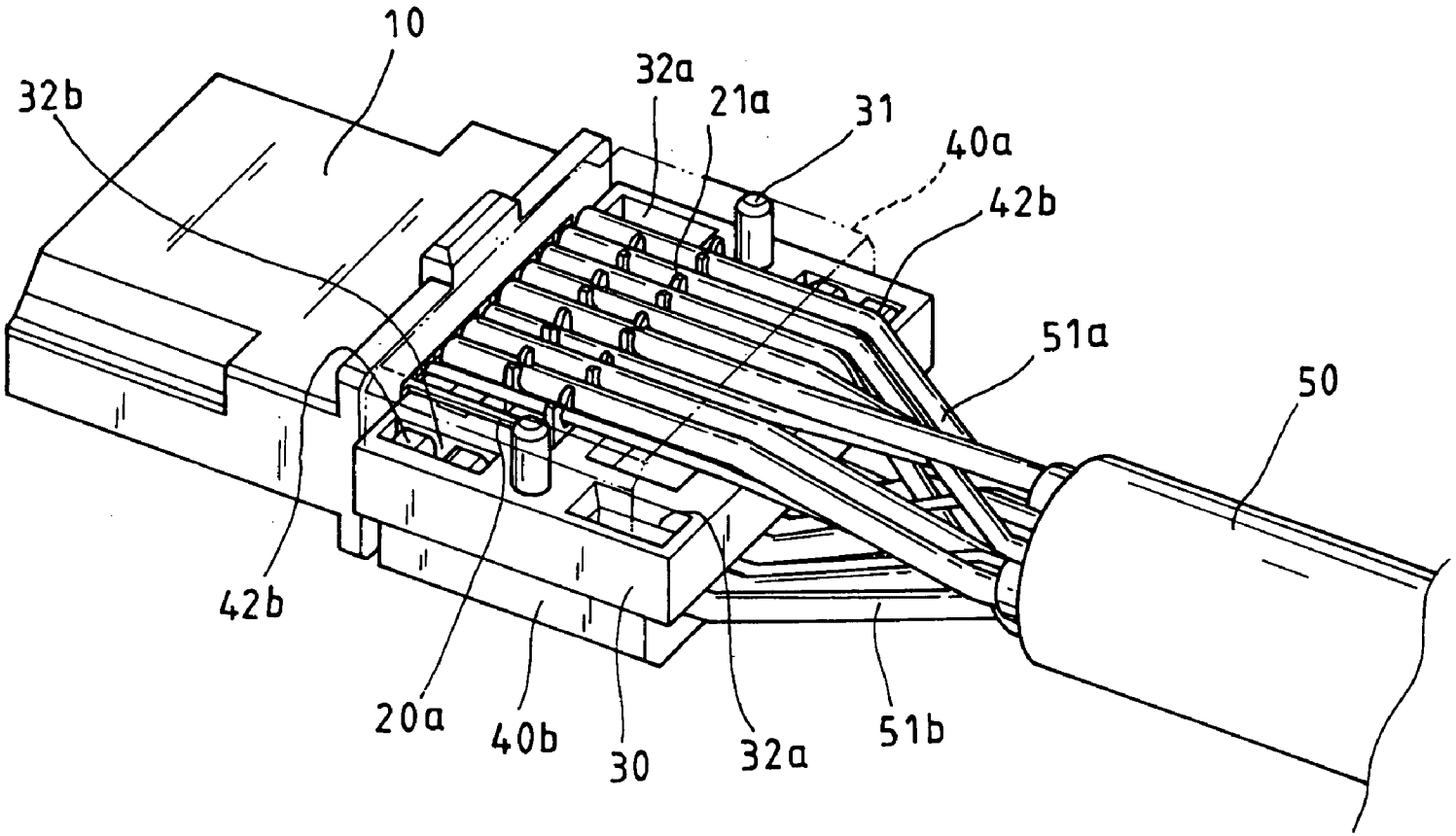
FIG. 9 is similar to FIG. 8 but showing the top cover board removed.

FIG. 8 shows the top cover board 40*a* and the bottom cover board 40*b* fastened to the top and bottom sides of the locating board 30. FIG. 9 shows the connection status between the first lead wires 51*a* and the first terminals 20*a* after removal of the top cover board 40*a* from the locating board 30. As indicated above, the lead wires 51*a* and 51*b* of the cable 50 can easily and positively be fastened to the first terminals 20*a* and the second terminals 20*b* without soldering or riveting and without causing interference. Further, because the lead wires 51*a* and 51*b* of the cable 50 are held down by the locating grooves 43*a* and 43*b* of the cover boards 40*a* and 40*b*, they are maintained in positive contact with the terminals 20.

Figure 10:
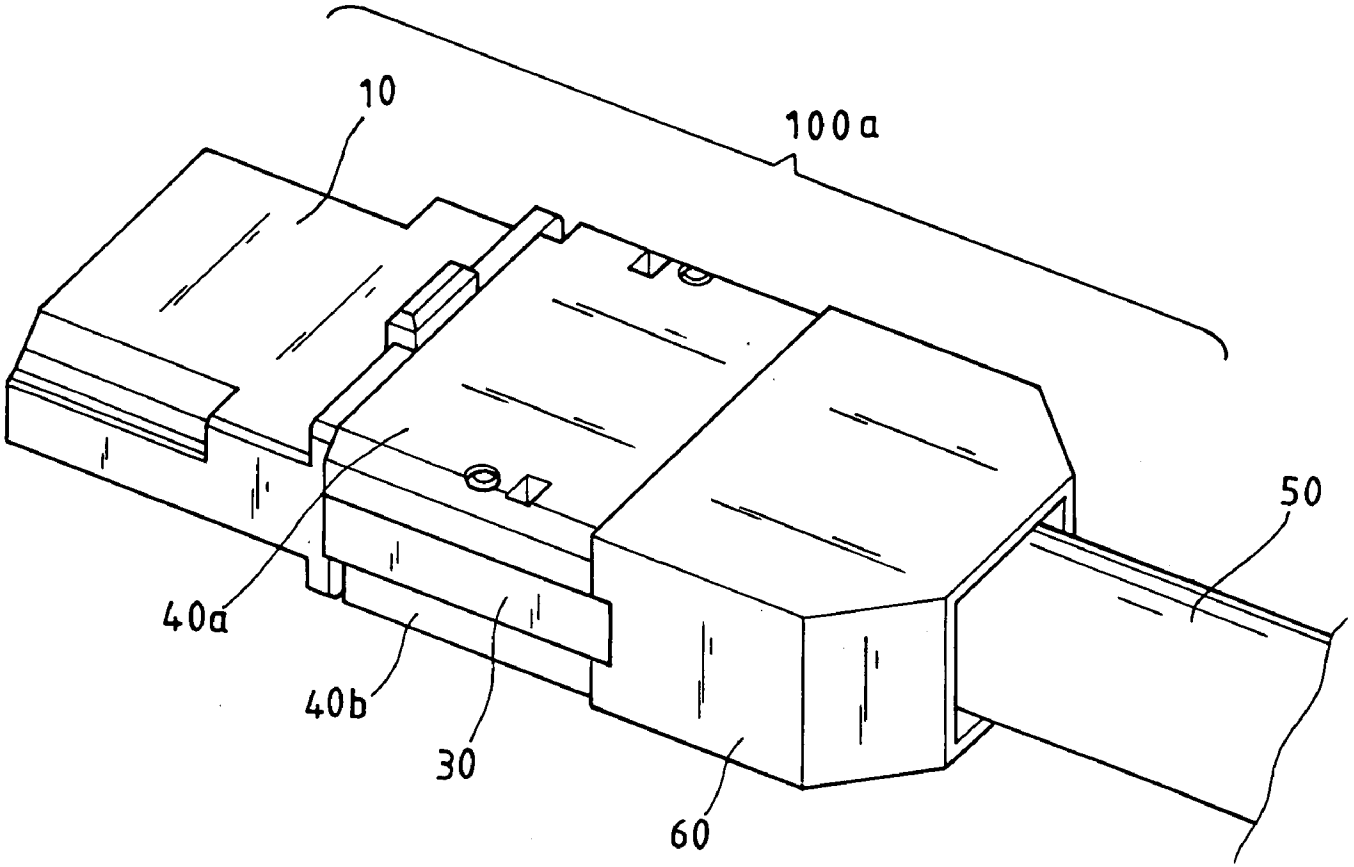
FIG. 10 is an elevational view of a part of the HDMI (Hi-Definition Mutimedia Interface) connector according to the present invention, showing the connector body assembled.

Referring to FIG. 10, a protective cap 60 is mounted on the cable 50 and closely attached to the cover boards 40*a* and 40*b* and the locating board 30 at the rear side to protect the lead wires 51*a* and 51*b* of the cable 50 and to keep the lead wires 51*a* and 51*b* from sight, thereby forming a connector body 100.

Figure 11:
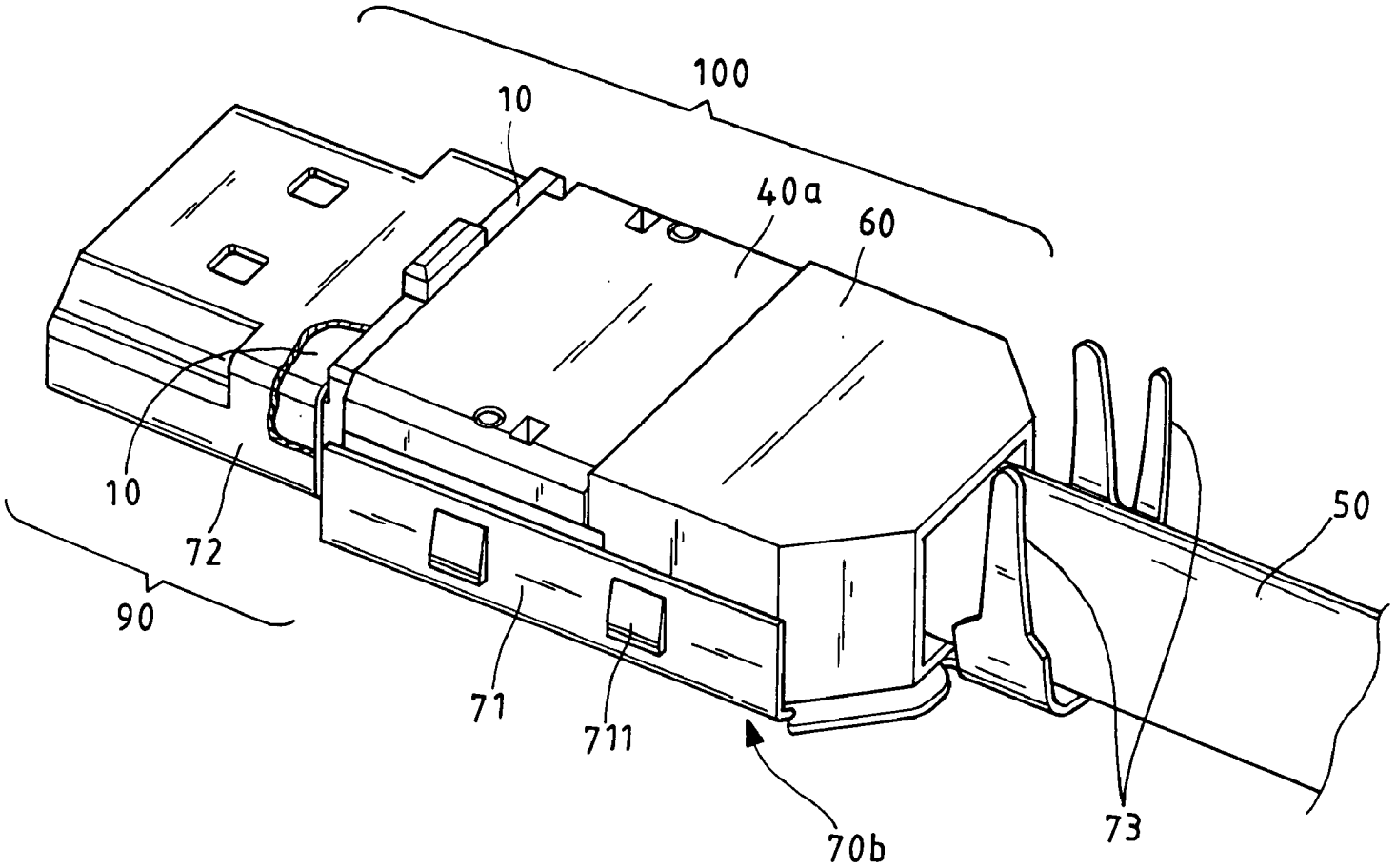
FIG. 11 corresponds to FIG. 10, showing the bottom shell of the metal shield fastened to the connector body.
Figure 12:
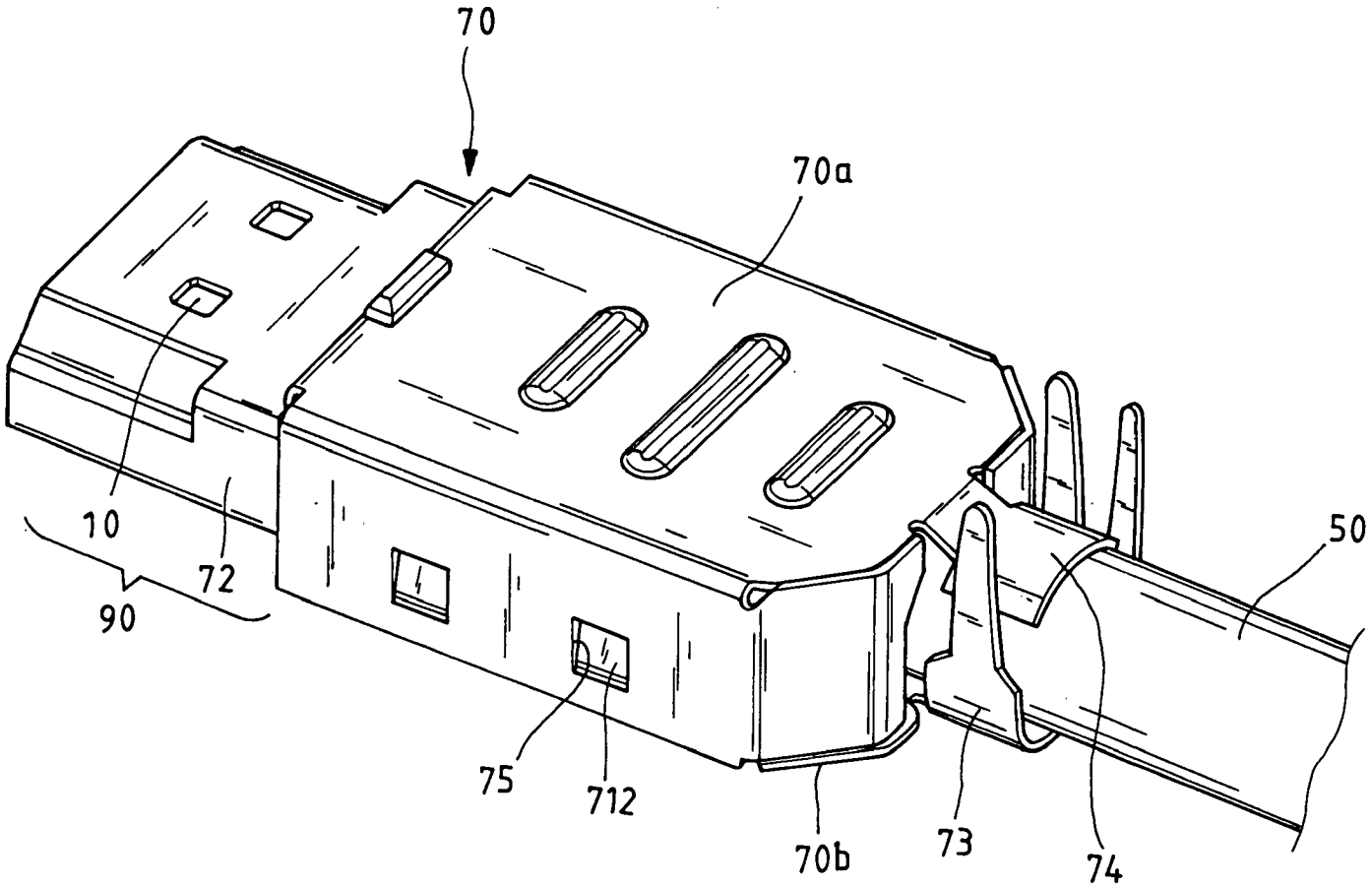
FIG. 12 corresponds to FIG. 11, showing the top cover shell of the metal shield covered on the connector body and fastened to the bottom shell.
Figure 13:
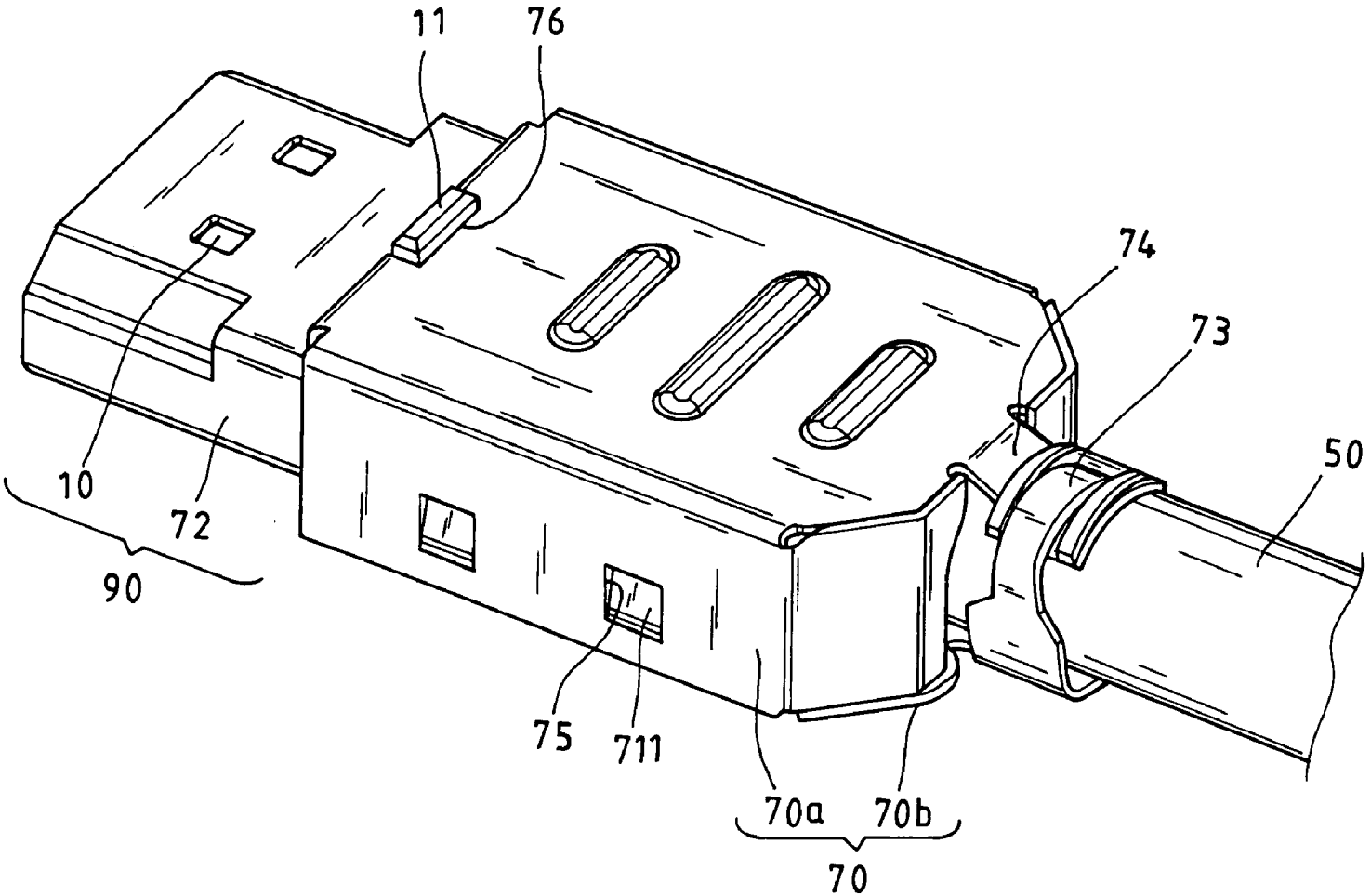
FIG. 13 corresponds to FIG. 12, showing the clamping portion of the bottom shell clamped on the extension strip of the top cover shell around the periphery of the outer insulator of the cable.

Referring to FIGS. 11~13, a metal shield 70 is covered on the connector body 100 for EMI (Electromagnetic interference) protection. The metal shield 70 comprises a bottom shell 70*b* and a top cover shell 70*a*. During installation, the bottom shell 70*b* comprises a substantially U-shaped shell body 71, a front socket portion 72 at the front side of the shell body 71, and a rear clamping portion 73 at the rear side of the shell body 71. The shell body 71 has a plurality of protruding hooked portions 711 symmetrically disposed at two opposite lateral sides. The top cover shell 70*a* is a substantially U-shaped metal sheet member invertedly covered on the bottom shell 70*b*, having a plurality of retaining holes 75 symmetrically disposed at two opposite lateral sides and a rear extension strip 74. During installation, the connector body 100 is put in the shell body 71 of the bottom shell 70*b*, and the casing 10 is inserted into the front socket portion 72 of the bottom shell 70*b* and form with the front socket portion 72 of the bottom shell 70*b* a connection interface 90. Thereafter, the top cover shell 70*a* is covered on the connector body 100 and fastened to the bottom shell 70*b* by forcing the retaining holes 75 into engagement with the protruding hooked portions 711 of the shell body 71, and then the clamping portion 73 is fastened to the periphery of the outer insulator of the cable 50 and clamped on the rear extension strip 74 Further, the bottom shell 70*b* and the top cover shell 70*a* each have a locating hole 76 respectively coupled to the protruding blocks 11 of the casing 10.

Figure 14:
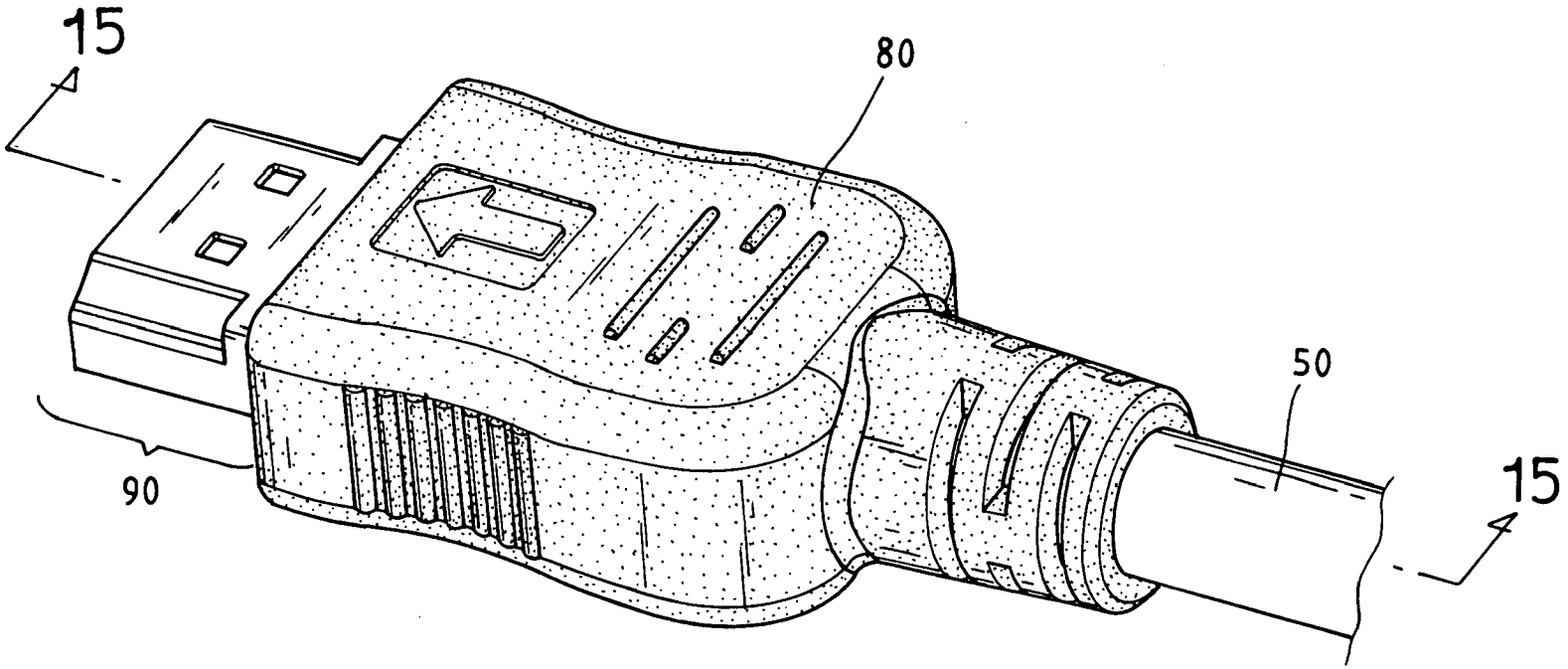
FIG. 14 is an elevational view showing the finished status of the HDMI (Hi-Definition Mutimedia Interface) connector according to the present invention.

Referring to FIG. 14, a housing 80 is directly molded from plastics on the metal shield 70 and the cable 50, keeping the connection interface 90 exposed to the outside.

Figure 15:
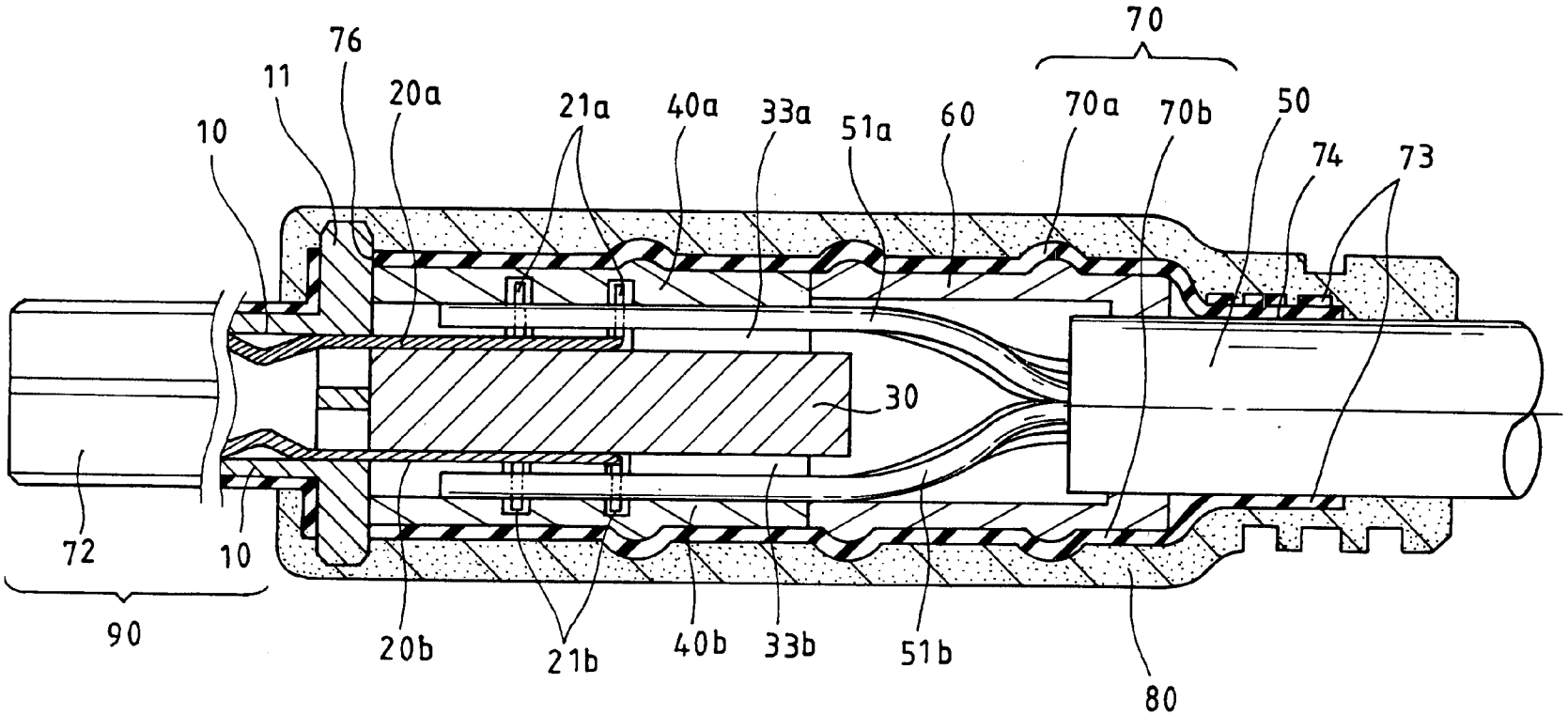
FIG. 15 is a sectional view in an enlarged scale taken along line 15—15 of FIG. 14.

Referring to FIG. 15, the top cover board 40*a* and the bottom cover board 40*b* hold down the lead wires 51*a* and 51*b* of the cable 50 in the upwardly extended, forked, sharp-edged endpieces 21*a* of the first terminals 20*a* and the downwardly extended, forked, sharp-edged endpieces 21*b* of the second terminals 20*b*.

A prototype of HDMI connector has been constructed with the features of FIGS. 3~15. The HDMI connector functions smoothly to provide all of the features discussed earlier.

Although a particular embodiment of the present invention has been shown and described, it will be understood that various modifications and changes could be made thereunto without departing from the spirit and scope of the invention disclosed.

What is claimed is:

1. A Hi-definition Multimedia Interface (HDMI) connector comprising:

an electrically insulative casing, said casing comprising two protruding blocks respectively vertically extended from a rear sidewall thereof on the middle in reversed directions;

a set of terminals, said terminals including a plurality of first terminals horizontally arranged in said casing at an upper side and a plurality of second terminals horizontally arranged in said casing at a lower side below said first terminals, said first terminals being axially alternatively extended out of the rear sidewall of said casing at two different distances, said second terminals being axially alternatively extended out of the rear sidewall of said casing at two different distances, said first terminals each having an upwardly extended, forked, sharp-edged endpiece suspending outside the casing, said second terminals each having a downwardly extended, forked, sharp-edged endpiece suspending outside said casing;

an electrically insulative locating board fastened to said casing and set between said first terminals and said second terminals, said locating board comprising a plurality of first locating pins and second locating pins respectively perpendicularly extended from top and bottom sides thereof on the middle, and a plurality of locating holes in four corners thereof;

a top cover board and a bottom cover board respectively fastened to the top and bottom sides of said locating board, said top cover board and said bottom cover board each having a plurality of mounting holes respectively coupled to the first locating pins and second locating pins of said locating board, and a plurality of retainers respectively fastened to the locating holes of said locating board, said top cover board having a plurality of parallel terminal grooves formed in a bottom side thereof for accommodating the upwardly extended, forked, sharp-edged endpieces of said first terminals, said bottom cover board having a plurality of parallel terminal grooves formed in a top side thereof for accommodating the downwardly extended, forked, sharp-edged endpieces of said second terminals;

a cable, said cable having a plurality of lead wires arranged into two groups respectively inserted into the terminal grooves of said top cover board and the terminal grooves of said bottom cover board and respectively held down in the upwardly extended, forked, sharp-edged endpieces of said first terminals and the downwardly extended, forked, sharp-edged endpieces of said second terminals by said top cover board and said bottom cover board and respectively kept in electric contact with said first terminals and said second terminals;

a protective cap mounted on said cable and closely attached to said top cover board and said bottom cover board and said locating board at a rear side to protect the lead wires of said cable and to keep the lead wires of said cable from sight;

a metal shield covered on said top cover board and said bottom cover board and said protective cap for EMI (Electromagnetic interference) protection, said metal shield having a part covered on the periphery of said casing and forming with said casing a connection interface; and a plastic housing molded on said metal shield said cable and to a portion of said connection interface.

2. The HDMI connector as claimed in claim 1, wherein said casing has a plurality of mounting holes bilaterally formed in the rear sidewall; said locating board has a plurality of plug rods extended from a front side thereof and respectively press-fitted into the mounting holes of said casing.

3. The HDMI connector as claimed in claim 1, wherein said metal shield comprises a bottom shell covered on said casing and said bottom cover board at a bottom side, and a top cover shell covered on said casing and said bottom cover board at a top side, said bottom shell comprising a substantially U-shaped shell body covered on said bottom cover board, a front socket portion extended from a front side of said shell body and coupled to said casing and forming with said casing said connection interface, and a rear clamping portion extended from a rear side of said shell body and clamped on the periphery of said cable, said shell body having a plurality of protruding hooked portions symmetrically disposed at two opposite lateral sides thereof, said top cover shell having a plurality of retaining holes symmetrically disposed at two opposite lateral sides thereof and respectively fastened to the protruding hooked portions of said shell body and a rear extension strip secured to the periphery of said cable by said clamping portion of said shell body.

* * * * *